US005206115A

United States Patent [19]

Waki

[11] Patent Number: 5,206,115

[45] Date of Patent: Apr. 27, 1993

[54] SILVER SALT DIFFUSION TRANSFER IMAGE-FORMING PROCESS

[75] Inventor: Koukichi Waki, Kanagawa, Japan

[73] Assignee: Fuji Photo Film Co., Ltd., Kanagawa, Japan

[21] Appl. No.: 885,868

[22] Filed: May 20, 1992

[30] Foreign Application Priority Data

May 20, 1991 [JP] Japan ..... 3-114563

[51] Int. Cl.[5] ..... G03C 5/54

[52] U.S. Cl. ..... 430/230; 430/233; 430/248; 430/249; 430/965

[58] Field of Search ..... 430/230, 233, 248, 249, 430/965

[56] References Cited

U.S. PATENT DOCUMENTS

| | | | |
|---|---|---|---|
| 3,236,642 | 2/1966 | Rintelen et al. | 430/233 |
| 4,436,805 | 3/1984 | Iguchi et al. | 430/233 |
| 4,734,354 | 3/1988 | Takagi | 430/233 |

*Primary Examiner*—Richard L. Schilling

*Attorney, Agent, or Firm*—Sughrue, Mion, Zinn, Macpeak & Seas

[57] ABSTRACT

A film unit for use in a silver salt diffusion transfer image-forming process is disclosed. The film unit includes a light-sensitive element, an alkaline treating element, and an image-receiving element. The light-sensitive element includes a light-sensitive silver halide emulsion layer containing a light-sensitive silver halide emulsion which contains silver bromoiodide or silver bromoiodochloride having a silver iodide content of 0.5 to 3.5 mol %, wherein silver bromoiodide having a silver iodide content of 1 to 5 mol % is formed on the surface of the silver halide grains in an amount of from 3 to 10% on a silver basis after completion of chemical sensitization. The alkaline treating element contains a water-soluble iodide in an amount of from 0.3 to 3.0 mM/l and tetrahydrophyrimidinethione in an amount of from 0.3 to 3.0 mM/l. The film unit allows rapid completion of transfer images without loss of photographing sensitivity. Pitch-black images can be obtained rapidly without the need for image stabilizing treatments. A silver salt diffusion transfer image-forming process employing the film unit is also disclosed.

2 Claims, No Drawings

SILVER SALT DIFFUSION TRANSFER IMAGE-FORMING PROCESS

FIELD OF THE INVENTION

This invention relates to a silver salt diffusion transfer image-forming process and to a film unit to be used in the process.

BACKGROUND OF THE INVENTION

Diffusion transfer processes are well known in the industry, and their details will not be described herein. Such processes are disclosed in detail for example in *Photographic Silver Halide Diffusion Processes* (A. Rott and E. Weyde, Focal Press, 1972), *Imaging Processes and Materials,* Neblette's Eighth Edition (J. Sturge, V. Walworth and A. Shepp, Van Nostrand Reinhold, 1989, Chapter 6, *Instant Photography and Related Reprographic Processes*), and *Modern Photographic Processing,* Vol. 2, G. Haist, John Wiley and Sons, 1979, Chapter 8, "Diffusion Transfer"). Various types of photographic materials can be prepared by diffusion transfer processes, and such preparation procedures are described in detail in the aforementioned sources. For example, it is known that a transfer image can be obtained when a light-sensitive element prepared by coating a silver halide emulsion on a support is superimposed on an image-receiving element prepared by coating an image-receiving layer containing silver precipitation nuclei on another support, and a treating element comprising a high viscosity alkaline treatment composition containing a developing agent and a silver halide solvent is spread between these two elements.

In the just described construction, a transfer image is obtained on the image-receiving element by subjecting the light-sensitive element to exposure, superimposing the exposed element on the image-receiving element, spreading the treating element between these two elements and then separating the image-receiving element and the exposed light-sensitive element from each other after a set period of time. Continuous efforts have been directed toward rapid completion of the transfer image.

As a means to quicken completion of the transfer image, a process has been proposed in which a highly reductive compound such as a hydroquinone compound is used as a developing agent in the treating element and a quickly soluble compound such as hypo is used as a silver halide solvent. In the case of this process, however, the transfer images obtained are very unstable and cannot be stored for prolonged periods of time because of generation of stains due to an oxidized product of the developing agent, sulfurization of residual hypo and the like. To prevent such problems, an anti-oxidation layer, such as a polyvinyl alcohol layer containing an alkali neutralizer, must be applied to the image surface immediately after the image is formed. The application of such anti-oxidation layers entails complex handling.

Another means to quicken completion of transfer images is a process in which highly soluble silver chloride, silver bromochloride or the like is used as the silver halide emulsion in the light-sensitive element. This process, however, has disadvantages. The low sensitivity of the light-sensitive element makes it impossible to apply this process to photographing purposes. Further, the nature of the light-sensitive elements used in this process is such that they are easily fogged and this causes a decrease in the density of the resulting transfer images.

JP-A-2-51155 (the term "JP-A" as used herein means an "unexamined published Japanese patent application") discloses that a pitch-black image with hard toe gradation can be obtained by the combined use of a silver halide emulsion containing 1 mol % or more of silver iodide, a hydroxylamine developer and a water soluble iodide. This process, however, is not preferable, because completion of images becomes slow and the hue becomes bluish when treated with the treating element containing a water-soluble iodide and in a silver iodide content in the silver halide emulsion of 5 mol % or more.

Research Disclosure (RD) No. 9245 proposes a developing solution for surface and internal use which contains 3-pyrazolidone, ascorbic acid, a nitrogen-substituted heterocyclic thione or thiol compound and an alkali metal iodide, and discloses that a high density image can be obtained with a high sensitivity by use of this developing solution. However, when this developing solution is applied to the diffusion transfer system of the present invention, a high density transfer image cannot be obtained quickly because .of insufficient solubility of the developing solution against the silver halide emulsion.

SUMMARY OF THE INVENTION

In view of the above, an object of the present invention is to provide a process for quickening the completion of transfer images without losing high photographing sensitivity.

Another object of the present invention is to provide a process for obtaining pitch-black images with quick transfer image completion which does not require an image stabilizing treatment after the light-sensitive element and the image-receiving element are peeled apart.

A further object of the present invention is to provide a film unit which is used in the above-described silver salt diffusion transfer image-forming process.

That is, the present invention relates to a silver salt diffusion transfer image-forming process which comprises developing an imagewise exposed light-sensitive element comprising a light-sensitive silver halide emulsion layer using an alkaline treating element containing a silver halide solvent, thereby converting at least a portion of the unexposed silver halide in the emulsion layer into a transferable complex silver salt, and subsequently transferring at least a portion of the complex silver salt to an image-receiving element comprising an image-receiving layer containing silver precipitation nuclei, wherein the light-sensitive silver halide emulsion layer comprises silver bromoiodide or silver bromoiodochloride having a silver iodide content of 0.5 to 3.5 mol %, wherein silver bromoiodide having a silver iodide content of 1 to 5 mol % is formed on the surface of the silver halide grains in an amount of from 3 to 10% on a silver basis after completion of chemical sensitization, and wherein the alkaline treating element comprises a water-soluble iodide in an amount of from 0.3 to 3.0 mM/l and tetrahydrophyrimidinethione in an amount of from 0.3 to 3.0 mM/l.

Also, the present invention relates to a silver salt diffusion transfer image-forming film unit comprising a light-sensitive element having a light-sensitive silver halide emulsion layer, an alkaline treating element, and an image-receiving element, wherein the light-sensitive silver halide emulsion layer contains a light-sensitive silver halide emulsion which comprises silver bromoiodide or silver bromoiodochloride having a silver iodide content of 0.5 to 3.5 mol %, wherein silver bromoiodide having a silver iodide content of 1 to 5 mol % is formed on the surface of the silver halide grains in an amount of from 3 to 10% on a silver basis after completion of chemical sensitization, and wherein the alkaline treating element comprises a water-soluble iodide in an amount of from 0.3 to 3.0 mM/l and tetrahydrophyrimidinethione in an amount of from 0.3 to 3.0 mM/l.

Other objects and advantages will become apparent as the description progresses.

DETAILED DESCRIPTION OF THE INVENTION

Examples of water-soluble iodides which may be used in the present invention include alkali metal iodides such as sodium iodide, potassium iodide, cesium iodide and the like and iodides of quaternary salts containing nitrogen, phosphorus and the like, of which sodium iodide and potassium iodide are particularly preferred. Each of the water-soluble iodide and tetrahydropyrimidinethione may be used preferably in an amount of from 0.3 to 3.0 mM/l, more preferably from 0.5 to 2.5 mM/l.

The mean silver iodide content of the silver halide emulsion grains of the present invention is preferably in the range of from 0.5 to 3.5 mol %, more preferably from 1.0 to 3.0 mol %, most preferably from 1.5 to 3.0 mol %. In addition, it is preferable that there be a difference in the silver iodide content from the surface to the core of the grains. A high silver iodide content in the grain cores and a low content at the grain surfaces results in high sensitivity and a high dissolving rate and therefore rapid completion of transfer images. Taking sensitivity and fogging into consideration, the silver chloride content is preferably 1 mol % or less.

Formation of silver bromoiodide on the grain surfaces after chemical sensitization is a markedly effective means to achieve a higher sensitivity without decreasing the dissolving rate. The amount of silver bromoiodide to be formed on the grain surface after chemical sensitization of the silver halide is preferably in the range of from 3 to 10% (silver iodide content: 1 to 5 mol %), more preferably from 3 to 8% on a silver basis. The silver content if substantially above or below the range of the present invention would provide no significant results, and would rather entail a decrease in sensitivity. The amount of silver bromoiodide on the grain surfaces is preferably in the range of from 2 to 4% as silver iodide content. Too large a silver iodide content will decrease the dissolving rate and therefore delay the completion of the transfer image. Silver bromoiodide may be formed on the grain surfaces using several known methods. These include, for example, a process in which silver and halogen ions are added after chemical sensitization, a process in which a fine grain emulsion of silver bromoiodide is added and recrystallized on the host grains by Ostwald ripening, and a process in which a fine grain emulsion of silver bromide and an aqueous potassium iodide solution are added and recrystallized on the host grains by Ostwald ripening.

With regard to the halogen composition distribution in the silver halide grains of the present invention, any type of grains, including grains having a halogen composition distribution as described above, may be used. Suitable grains include homogeneous structure type grains in which every part in the grains has the same composition, laminate type grains in which the core and its surrounding shell (single or multiple layers) in the grain have different compositions, and grains of a type in which the internal or surface area of the grains has non-layer portions having different compositions (when such a structure exists on the surface of the grains, its edge, corner or face is fused with a part of different composition). Either of the latter two types, rather than the homogeneous type grains, may be used advantageously for the purpose of obtaining high sensitivity, as well as pressure resistance. When silver halide grains have the aforementioned structures with different halogen compositions, these compositions may have distinct boundaries or indistinct ones by the formation of mixed crystals, or they may be made artificially into a continuously changing structure.

Depending on the type of silver halide grains used in the present invention, a latent image may be formed mainly in the surface area of the grains or mainly in the internal area of the grains, or may not be localized in either of them. Particularly preferred grains are those which have a latent image forming moiety such that the maximum sensitivity can be obtained under the following conditions.

The conditions for confirming the position of the latent image are as follows: A silver halide emulsion is coated on a polyethylene terephthalate film to a density of 1 g/m$^2$ on a silver basis, the coated film is exposed using a sample having a gelatin protective layer and then developed at 20° C. for 20 minutes with a treating solution containing MAA-1 and 0.3 g/l hypo.

The silver halide grains of the present invention may have various crystal forms which include: regular crystal forms such as cubic, octahedral and the like crystal forms; irregular crystal forms such as spherical, tabular and the like crystal forms; and complex systems of these crystal forms.

The mean grain size of the silver halide grains (expressed in terms of the diameter of an equivalent sphere) of the present invention is not particularly restricted, but is preferably 4 μm or smaller, more preferably 3 μm or smaller, and most preferably in the range of from 0.2 to 2 μm. The grain size distribution may be narrow or broad.

The emulsion to be used in the present invention may be prepared in accordance with known methods disclosed for example in *Chimie et Physique Photographique* (P. Glafkides, Paul Montel, 1967), *Photographic Emulsion Chemistry* (G. F. Duffin, Focal Press, 966) and *Making and Coating Photographic Emulsions* (V. L. Zelikman et al, Focal Press, 1964). That is, any of the acid, neutral and ammonia methods may be used. Also, methods in which soluble silver salts are allowed to react with soluble halides may be used. In these methods, either separate mixing or simultaneous mixing or a combination of both may be used. A reverse mixing method in which grains are formed in an atmosphere of excess silver ions is also useful. As an example of a simultaneous mixing method, the controlled double-jet method in which the pAg in the silver halide-forming liquid phase is controlled at a constant level may be used. With this method, a silver halide emulsion with regular crystal form and nearly uniform grain size can be obtained. In addition, tabular forms of silver halide grains with nearly uniform grain size may be obtained for example by making use of the method disclosed in U.S. Pat. No. 4,797,354.

In addition to salts or complex salts of iron and iridium, various polyvalent metal ion compounds may be introduced into the silver halide emulsion of the present invention during the emulsion grain forming or physical ripening step. Examples of such compounds include: salts of cadmium, zinc, lead, thallium and the like; and salts or complex salts of the group VIII metals in the periodic table such as of ruthenium, rhodium, palladium, osmium, platinum and the like. Of these, the group VIII metals are most preferred. These compounds may be used in a broad range of amounts depending on the purpose, but preferably in an amount of from $10^{-9}$ to $10^{-4}$ mole per mole of the silver halide to be used.

The chemical sensitization to be applied to the silver halide emulsion of the present invention may be carried out by the use of the procedures disclosed for instance in the aforementioned literature references authored by Glafkides, Duffin and Zelikman respectively, as well as in *Die Grundlagen der Photographischen Prozesse mit Silberhalogeniden* (H. Frieser, Akademische Verlagsgesellschaft, 1968).

In other words, the chemical sensitization may be effected by the single or combined use of: a sulfur sensitization technique in which sulfur-containing compounds that are reactive with active gelatin and silver (for example, thiosulfates, thioureas, mercapto compounds, rhodanine compounds and the like) are used; a noble metal sensitization technique in which noble metals (for example, a complex salt of gold and complex salts of the group VIII metals in the periodic table such as of platinum, iridium, palladium and the like) are used; and a reduction sensitization technique in which reductive compounds (for example, stannous salts, amines, hydrazine derivatives, formamidinesulfinic acids, silane compounds and the like) are used.

Preferred spectral sensitizers to be used in the silver halide emulsion of the present invention include cyanine dyes, merocyanine dyes, complex cyanine dyes, complex merocyanine dyes, holopolar cyanine dyes, hemicyanine dyes, styryl dyes and hemioxonol dyes, of which cyanine dyes, merocyanine dyes and complex merocyanine dyes are particularly preferred. Illustrative examples of these dyes are disclosed in *Heterocyclic Compounds—Cyanine Dyes and Related Compounds* (F. M. Hamer, John Wiley and Sons, 1964). Also useful are those disclosed in U.S. Pat. No. 2,493,478, U.S. Pat. No. 2,519,001, U.S. Pat. No. 2,977,229, U.S. Pat. No. 3,480,434, U.S. Pat. No. 3,672,897, U.S. Pat. No. 3,703,377, U.S. Pat. No. 2,688,545, U.S. Pat. No. 2,912,329, U.S. Pat. No. 3,397,060, U.S. Pat. No. 3,615,635, U.S. Pat. No. 3,628,964, British Patent 1,195,302, British Patent 1,242,588, British Patent 1,293,862, German Patent OLS 2,030,326, German Patent OLS 2,121,780, JP-B-43-4936, JP-B-44-14030, JP-B-43-10773, U.S. Pat. No. 3,511,664, U.S. Pat. No. 3,522,052, U.S. Pat. No. 3,527,641, U.S. Pat. No. 3,615,613, U.S. Pat. No. 3,615,632, U.S. Pat. No. 3,617,295, U.S. Pat. No. 3,635,721, U.S. Pat. No. 3,694,217, British Patent 1,137,580 and British Patent 1,216,203. (The term "JP-B" as used herein means an "examined Japanese patent publication".)

As disclosed in JP-A-59-114533 and JP-A-61-3334, a plurality of spectral sensitizers may be used in combination.

The thickness of the light-sensitive element of the present invention may be in the range of from 0.5 to 8.0 μm, preferably from 1.0 to 6.0 μm, and the amount of the silver halide grains to be coated may be in the range of from 0.1 to 3.0 g/m$^2$, preferably from 0.2 to 2.0 g/m$^2$, on a silver basis.

To prevent fogging and stabilize photographic performance during the production process and storage of the photographic material or during photographic treatment, various compounds may be added to the light-sensitive silver halide emulsion layer of the present invention.

For this purpose, well known antifogging agents and stabilizing agents are preferably used, which include azoles (for example, benzothiazole salts, nitroimidazoles, nitrobenzimidazoles, cholorobenzimidazoles, bromobenzimidazoles, mercaptothiazoles, mercaptobenzothiazoles, mercaptobenzimidazoles, mercaptothiadiazoles, aminotriazoles, nitrobenzotriazoles and benzotriazoles), mercaptopyrimidines, mercaptotriazines, thioketo compounds, azaindenes (for example, triazaindenes, tetrazaindenes and pentazaindenes), benzenesulfonates, benzenesulfinates, benzenesulfonate amides, α-lipoic acid and the like. Illustrative examples of these compounds include 1-phenyl-2-mercaptotetrazole, 4-hydroxy-6-methyl-1,3,3a,7-tetrazaindene, 2-mercaptobenzothiazole, 5-carboxybutyl-1,2-dithiolan and the like. More detailed illustrative examples of these compounds and their use are disclosed for instance in U.S. Pat. No. 3,982,947 and JP-B-52-28660.

Inorganic or organic hardening agents may be added to the light-sensitive element of the present invention. Examples of such agents include: chromium salts such as chromium alum, chromium acetate and the like; aldehydes such as formaldehyde, glyoxal, glutaraldehyde and the like; N-methylol compounds such as dimethylolurea, methyloldimethylhydantoin and the like; dioxane derivatives such as 2,3-dihydroxydioxane and the like; active vinyl compounds such as 1,3,5-triacryloylhexahydro-s-triazine and the like; and mucohalogeno acids such as mucochloric acid, mucophenoxychloric acid and the like. These compounds may be used alone or as a mixture of two or more.

Coating aids may be used in the silver halide emulsion layer and other hydrophilic colloid layers of the light-sensitive element of the present invention. Compounds useful as coating aids may be selected from those disclosed in *Research Disclosure*, Vol. 176, 17643, p. 26, Dec. 1978 (in a chapter entitled "Coating aids") and in JP-A-61-20035.

To increase sensitivity and contrast or to enhance development, various compounds may be used in the silver halide emulsion layer and other hydrophilic colloid layers of the light-sensitive- element of the present invention, such as polyalkylene oxides or ether, ester, amine and similar derivatives thereof, thioether compounds, thiomorpholines, quaternary ammonium compounds, urethane derivatives, urea derivatives, imidazole derivatives, 3-pyrazolidones and the like.

To improve dimensional stability, dispersions of water-insoluble or slightly soluble synthetic polymers may be used in the silver halide emulsion layer and other hydrophilic colloid layers of the light-sensitive element of the present invention. Polymers useful for this purpose may consist of a single monomer or a plurality of monomers such as alkyl (meth)acrylates, alkoxyalkyl (meth)acrylates, glycidyl (meth)acrylamide, vinyl esters (vinyl acetate for example), acrylonitrile, olefins, styrene and the like, or combinations thereof with acrylic acid, methacrylic acid, $\alpha,\beta$-unsaturated dicarboxylic acids, hydroxyalkyl (meth)acrylates, styrenesulfonic acid and the like.

The silver halide emulsion layer of the present invention may consist of a plurality of layers. Also, a protective layer may be superimposed on the silver halide emulsion layer. Such a protective layer may comprise a hydrophilic polymer such as gelatin and may contain a matting agent or a slipping agent such as polymethyl methacrylate latex, silica or the like as has been disclosed in JP-A-61-47946 and JP-A-61-75338.

To effect filtering or to prevent irradiation, a dyestuff or an ultraviolet ray absorbing agent may be added to the silver halide emulsion layer and other hydrophilic colloid layers of the light-sensitive element of the present invention.

In addition, the light-sensitive element of the present invention may also contain antistatic agents, plasticizers and aerial fog preventing agents.

Though gelatin may be advantageous as a hydrophilic binder to be used in the light-sensitive element of the present invention, other hydrophilic binders may also be useful. Examples of such binders include: proteinous materials such as gelatin derivatives, graft polymers of gelatin with other polymers, albumin, casein and the like; cellulose derivatives such as hydroxyethyl cellulose, carboxymethyl cellulose, cellulose sulfate and the like; sugars such as sodium alginate, starch derivatives and the like; and synthetic hydrophilic polymers such as polyvinyl alcohol, polyvinyl alcohol partial acetal, poly-N-vinylpyrrolidone, polyacrylamide, polyvinyl imidazole, polyvinyl pyrazole and the like and copolymers thereof.

Useful types of gelatin include lime-treated gelatin and acid-treated gelatin, the latter being disclosed in *Bull. Soc. Sci. Phot. Japan* (No. 16, p. 30, 1966), as well as hydrolyzates and enzyme-digests of gelatin.

Gelatin derivatives may be prepared by allowing gelatin to react with acid halides, acid anhydrides, isocyanates, bromoacetate, alkane sultones, vinylsulfonamides, maleinimide compounds, polyalkylene oxides, epoxy compounds and the like. Illustrative examples of these derivatives are disclosed for instance in U.S. Pat. No. 2,614,928, U.S. Pat. No. 3,132,945, U.S. Pat. No. 3,186,846, U.S. Pat. No. 3,312,553, British Patent 861,414, British Patent 1,033,189, British Patent 1,005,784 and JP-B-42-26845.

A gelatin graft polymer may be obtained by graft polymerization of gelatin with a vinyl monomer such as acrylic acid, methacrylic acid, an acrylic ester, acrylamide, acrylonitrile, styrene or the like or a copolymer thereof. Illustrative examples of these polymers are disclosed for instance in U.S. Pat. No. 2,763,625, U.S. Pat. No. 2,831,767 and U.S. Pat. No. 2,956,884.

The image-receiving element of the present invention comprises an image-receiving layer containing silver precipitation nuclei supported on a support such as baryta paper, polyethylene laminate paper, cellulose triacetate, a polyester compound or the like. Preferable, such an image-receiving element may be obtained by coating a support with a coating solution prepared by dispersing silver precipitation nuclei in an appropriate cellulose ester such as cellulose diacetate. If desired, the support may be subbed prior to this step. The thus prepared cellulose ester layer is then subjected to alkaline hydrolysis to convert at least a portion in the depth direction of the cellulose ester layer to cellulose. As a particularly useful illustrative example, the silver precipitation nuclei layer and/or its lower cellulose ester layer not having been subjected to the alkaline hydrolysis, for example a non-hydrolyzed portion of the cellulose ester layer containing cellulose diacetate, may contain at least one mercapto compound with the aim of improving photographic properties such as hue and stability of silver transfer images and the like. Such a mercapto compound is utilized due to diffusion from its initially present portion during the imbibition process. An example of an image-receiving element of this type is disclosed in U.S. Pat. No. 3,711,283. Preferred examples of such mercapto compounds are disclosed in JP-A-49-120634, JP-B-56-44418, British Patent 1,276,961, JP-B-56-21140, JP-A-59-231537 and JP-A-60-122939.

Illustrative examples of silver precipitation nuclei include heavy metals such as iron, lead, zinc, nickel, cadmium, tin, chromium, copper, cobalt and the like and noble metals such as gold, silver, platinum, palladium and the like. Other useful silver precipitation nuclei include sulfides and selenides of heavy and noble metals, especially of mercury, copper, aluminum, zinc, cadmium, cobalt, nickel, silver, lead, antimony, bismuth, cerium, magnesium, gold, platinum and palladium. Of these, gold, platinum and palladium or sulfides thereof are particularly preferred.

It is preferable to interpose an acidic polymer layer for neutralization use (alkaline neutralization layer) between the non-sponified layer (timing layer) and the support. For this purpose, polymer acids and the like disclosed for instance in U.S. Pat. No. 3,594,164 may be used. Preferred examples of polymer acids include: maleic anhydride copolymers such as a styrene-maleic anhydride copolymer, a methyl vinyl ether-maleic anhydride copolymer, an ethylene-maleic anhydride copolymer and the like; and (meth)acrylic acid (co)polymers such as an acrylic acid-alkyl acrylate copolymer, an acrylic acid-alkyl methacrylate copolymer, a methacrylic acid-alkyl acrylate copolymer, a methacrylic acid-alkyl methacrylate copolymer and the like. Also useful are polymers containing sulfonic acid, such as polyethylenesulfonic acid, acetal compounds prepared from benzaldehydesulfonic acid and polyvinyl alcohol.

The neutralization layer may also contain a mercapto compound which is used in the timing layer. In addition, for the purpose of improving physical properties of the film, the polymer acid may be mixed with an alkali-impermeable polymer (preferably the aforementioned cellulose ester) or an alkali-permeable polymer.

Also, it is preferable to include an image stabilizing layer in the image-receiving layer of the present invention in order to improve the preservability of the images. For this purpose, cationic high-molecular weight electrolytes are used preferably as the stabilizing agent. Particularly preferred examples of these electrolytes include: water dispersion latexes disclosed for instance in JP-A-59-166940, U.S. Pat. No. 3,958,995, JP-A-55-142339, JP-A-54-126027, JP-A-54-155835 and JP-A-53-30328; polyvinylpyridinium salts disclosed for instance in U.S. Pat. No. 2,548,564, U.S. Pat. No. 3,148,061 and U.S. Pat. No. 3,756,814; water-soluble quaternary ammonium salt polymers disclosed for instance in U.S. Pat. No. 3,709,690; and water-insoluble quaternary ammonium salt polymers disclosed for instance in U.S. Pat. No. 3,898,088.

As a binder for the image stabilizing layer, cellulose acetate is preferably used, especially cellulose diacetate having an acetylation degree of from 40 to 49%. Preferably, the image stabilizing layer is interposed between the aforementioned neutralization layer and the timing layer.

To prevent a prolonged timing period due to changes in the structure of the cellulose ester during long-term preservation or shortening of the timing period, the timing layer may further contain an acid polymer such as a copolymer of a methyl vinyl ether with maleic anhydride, a copolymer of a methyl vinyl ether with a maleic anhydride half ester and the like.

In addition, the timing and neutralization layers may contain a white pigment such as titanium dioxide, silicon dioxide, kaolin, zinc dioxide, barium sulfate or the like, in order to prevent invasion of light from sectional direction of the sheet (light piping). The timing and neutralization layers may also contain a plasticizer in order to prevent curling and to improve brittleness. Such a plasticizer may be selected from known compounds.

The image-receiving layer and timing layer may be interposed with an interlayer. As such an interlayer, a hydrophilic polymer such as gum arabic, polyvinyl alcohol, polyacrylamide or the like may be used.

It is preferable to superimpose a delamination layer on the surface of the image-receiving layer, in order to prevent adhesion of the treating solution to the surface of the image-receiving layer at the time of peeling after spreading with the treating solution. Preferred examples of compounds to be used in such a delamination layer include gum arabic, hydroxyethyl cellulose, carboxymethyl cellulose, polyvinyl alcohol, polyacrylamide and sodium alginate, as well as those compounds disclosed in U.S. Pat. No. 3,772,024, U.S. Pat. No. 3,820,999 and British Patent 1,360,653.

As a means to shade light, it is preferable to include a shading agent (for example, carbon black or an organic black pigment) in the support paper sheet to be used or to apply the shading agent to the back side of the support which may be coated further with a white pigment (for example, titanium dioxide, silicon dioxide, kaolin, zinc dioxide or barium sulfate) to make the back side white. Also, it is preferable to superimpose a protective layer on the surface of the uppermost layer. A matting agent may be added to the protective layer in order to improve adhesive properties and to allow writing on the material.

As binders for the shading layer and protective layer, gelatin, cellulose esters, polyvinyl alcohol and the like may be used.

According to the present invention, the light-sensitive element is preferably prepared using as a support a polyethylene terephthalate film which contains titanium dioxide or carbon black and which has subbing layers on both its sides and by coating the light-sensitive silver halide emulsion layer on one side of the support and a carbon black layer on the other side, both sides being further coated with protective layers.

Other preferred embodiments of the light-sensitive element may comprise as a support a polyethylene terephthalate film which contains titanium dioxide or carbon black and which has subbing layers on both its sides, front side layers prepared by laminating one side of the support with a titanium dioxide layer, a light-sensitive silver halide emulsion layer and a protective layer in that order, and back side layers prepared by laminating the other side of the support with a carbon black layer and a protective layer in that order. In addition, a chromatic dye may be used instead of or together with the aforementioned carbon black. When the polyethylene terephthalate film contains carbon black and/or a chromatic dye, the carbon black layer and/or the chromatic dye layer on one side of the support may be omitted. The aforementioned titanium dioxide may be replaced by other white pigments.

With regard to the support, paper laminated with polyethylene, baryta paper and cellulose triacetate may be used in addition to the aforementioned polyester compounds.

The aforementioned light-sensitive silver halide emulsion layer, protective layer, carbon black layer and other layers may generally contain a hydrophilic binder such as gelatin.

The treating element of the present invention comprises a developing agent, a silver halide solvent, an alkaline agent and a toning agent. If desired, however, the developing agent and/or the silver halide solvent may be contained in the light-sensitive element and/or the image-receiving element.

Examples of developing agents which may be used in the present invention include: benzene derivatives in which the ortho- or para-positions of the benzene nucleus are substituted by at least two hydroxyl and/or amino groups, such as hydroquinone, amidol, Metol, glycine, p-aminophenol and pyrogallol;- and hydroxylamines, especially primary and secondary aliphatic and aromatic N-substituted hydroxylamines or $\beta$-hydroxylamines which are soluble in aqueous alkalis, such as hydroxylamine, N-methylhydroxylamine, N-ethylhydroxylamine, the compounds disclosed in U.S. Pat. No. 2,857,276 and the N-alkoxyalkyl substituted hydroxylamines disclosed in U.S. Pat. No. 3,293,034.

Also useful are the hydroxylamine derivatives having a tetrahydrofurfuryl group disclosed in JP-A-49-88521, the amino reductones disclosed in German Patent OLS 2,009,054, German Pat. No. OLS 2,009,055, and German Patent OLS 2,009,078, the heterocyclic amino reductones disclosed in U.S. Pat. No. 4,128,425 and the tetraalkyl reductates disclosed in U.S. Pat. No. 3,615,440.

These developing agents may be used in combination with auxiliary developing agents such as phenidones, p-aminophenols and ascorbic acid, of which phenidones are particularly preferred.

The silver halide solvent to be used in the present invention may include commonly used fixing agents such as sodium thiosulfate, sodium thiocyanate, ammonium thiosulfate and other compounds disclosed in the aforementioned U.S. Pat. No. 2,543,181, as well as combinations of cyclic imides with nitrogen bases such as a combination of barbiturate or uracil with ammonia or an amine and the combination disclosed in U.S. Pat. No. 2,857,274. Also, 1,1-bissulfonylalkanes and derivatives thereof are known in the art and can be used as the silver halide solvent in the present invention.

The treatment composition contains alkalis, preferably an alkali metal hydroxide such as sodium hydroxide or potassium hydroxide.

When the treatment composition is spread as a thin layer between the superimposed light-sensitive element and image-receiving element, the composition preferably contains a polymer film forming agent or a thickening agent. Examples of the polymer film forming agent or thickening agent which may be contained in the treating element include: cellulose derivatives such as carboxymethyl cellulose, ethyl cellulose, hydroxyethyl cellulose, methyl cellulose, hydroxypropyl cellulose and the like; vinyl polymers such as polyvinyl alcohol; acrylic acid polymers such as polyacrylic acid, polymethacrylic acid and the like; and inorganic polymers such as water glass, of which hydroxyethyl cellulose and carboxymethyl cellulose are particularly preferred. These compounds may be added to the treatment composition in an amount effective to give an appropriate viscosity on the basis of the known principles of diffusion transfer photographic processes. The treatment composition may further contain other auxiliary agents known in the field of silver salt diffusion transfer processes, such as an antifogging agent, a stabilizer and the like.

The following examples are provided to illustrate the invention further in detail, but not by way of limitation.

In the following description, each value shown in square brackets "[ ]" indicates the coated amount of each component in $g/m^2$.

EXAMPLE 1

1. Preparation of Image-Receiving Element

An image-receiving element was prepared by coating a polyethylene-laminated paper with layers in the following order.

1) Neutralization Layer

Cellulose acetate (acetylation degree, 55%) [6.0], a copolymer of methyl vinyl ether with maleic anhydride [4.0], Uvitex OB (an optical whitener, a trade name of Ciba Geigy AG) [0.04] and 1-(4-hexylcarbamoylphenyl)-2,3-dihydroxyimidazol-2-thione [0.25]

2) Image Stabilizing Layer

Cellulose acetate (acetylation degree, 46%) [4.0] and [2.0] of a compound represented by the following formula

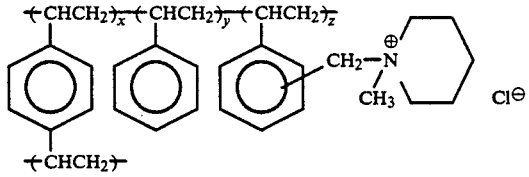

x:y:z = 5:47.5:47.5 by mole

3) Timing Layer

Cellulose acetate (acetylation degree, 55%) [8.0]

4) Image-Receiving Layer

Cellulose acetate (acetylation degree, 55%) [2.0], palladium sulfide [$7.5\times10^{-4}$] and 1-(4-hexylcarbamoylphenyl) -2,3-dihydroxyimidazol-2-thione [$1.0\times10^{-2}$]

5) Saponification

Saponification was carried out by treating the surface layer with a mixed solution prepared from 12 g of sodium hydroxide, 24 g of glycerol and 280 ml of methanol, followed by washing with water.

6) Delamination Layer

Copolymer of butyl methacrylate with acrylic acid (molar ratio, 15:85) [0.1]

7) Backing Layers

After completion of the lamination steps of the above layers on the front side of the support, the back side of the support was coated with layers in the following order.

7-1) Shading Layer

Carbon black [4.0] and gelatin [8.0]

7-2) White Layer

Titanium dioxide [6.0] and gelatin [0.7]

7-3) Protective Layer

Polymethyl methacrylate particles (mean particle size, 0.05 μm) [0.2] and gelatin [0.7]

2. Preparation of Light-Sensitive Element

A light-sensitive element was prepared by coating a support (a polyethylene terephthalate film) with layers in the following order.

1) Colloidal Silver Layer

Colloidal silver (mean particle size, 0.01 μm) [0.002] and gelatin [0.9]

2) Light-Sensitive Layer

Silver bromoiodide (homogeneous type grain structure; AgI content, 6.0 mol %) having an average particle size of 1.1 μm [0.55 on a silver basis], 4-hydroxy-6-methyl-1,3,3a,7-tetrazaindene [0.01], respective sensitizer dyes (A), (B) and (C) [$3.2\times10^{-4}$], [$3.2\times10^{-4}$] and [$1.2\times10^{-4}$] represented by the following formulae and gelatin [3.9]

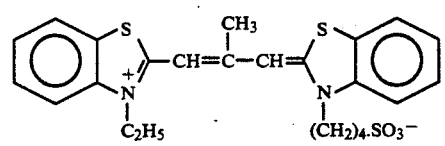

(A)

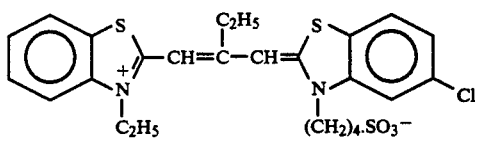

(B)

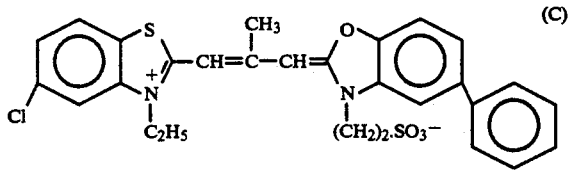

(C)

3) Protective Layer

Gelatin [0.7] and polymethyl methacrylate particles (mean particle size, 4.7 m) [0.1]

4) BACKING LAYERS

4-1) Shading Layer

Carbon black [4.0] and gelatin [2.0]

4-2) Protective Layer

Gelatin [0.7] and polymethyl methacrylate particles (mean particle size, 0.05 m) [0.1]

The light-sensitive element obtained above was designated (1A), and additional light-sensitive elements (1B) to (1D) were prepared by replacing the silver halide emulsion of the above light-sensitive layer 2) with other emulsions shown in Table 1.

TABLE 1

| Light-Sensitive Element | Emulsion | Structure of Host Grains | Uniform or Core/Shell AgI (mol %) | Halide Added to Surface as Ag (%) | Halide Added to Surface as AgI (mol %) | Remarks |
|---|---|---|---|---|---|---|
| 1A | A | uniform | 6.0 | — | — | Comparison |
| 1B | B | core/shell | 6.0/4.0 | — | — | Comparison |
| 1C | C | core/shell | 2.0/1.0 | 5 | 3 | Invention |
| 1D | D | core/shell | 4.0/1.0 | 3 | 5 | Invention |

Emulsions (A) to (D) used in light-sensitive elements (1A) to (1D) were prepared in the following manner.

Emulsion (A)

The following composition was used for the preparation of Emulsion (A).

| | | |
|---|---|---|
| (a) | $H_2O$ | 1000 cc |
| | KBr | 6.6 g |
| | Gelatin | 16.7 g |
| (b) | $AgNO_3$ | 4.0 g |
| | $NH_4NO_3$ (50%) | 0.4 cc |
| | $H_2O$ up to | 30 cc |
| (c) | KBr | 2.6 g |
| | KI | 0.2 g |
| | $H_2O$ up to | 30 cc |
| (d) | Gelatin | 9.2 g |
| | $H_2O$ | 92 cc |
| (e) | KBr (30%) | 50 cc |
| (f) | $NH_4NO_3$ (50%) | 15 cc |
| (g) | NaOH (1N) | 56 cc |
| (h) | $H_2SO_4$ (1N) | 54 cc |
| (i) | KSCN (1N) | 37.8 cc |
| (j) | $AgNO_3$ | 46.0 g |
| | $NH_4NO_3$ (50%) | 3.0 cc |
| | $H_2O$ up to | 276 cc |
| (k) | KBr | 30.3 g |
| | KI | 2.7 g |
| | $H_2O$ up to | 276 cc |
| (l) | $AgNO_3$ | 50.0 g |
| | $NH_4NO_3$ (50%) | 3.3 cc |
| | $H_2O$ up to | 300 cc |
| (m) | KBr | 32.9 g |
| | KI | 2.9 g |
| | $H_2O$ up to | 300 cc |
| (n) | Gelatin | 37 g |

A reaction tank was charged with (a) and then, after heating to 62° C., was simultaneously charged with (b) and (c) over a period of 1 minute. After 15 minutes, (d) was added to the mixture and physical aging was carried out for 15 minutes, followed by the addition of (e) and subsequent physical ripening for 20 minutes. Thereafter, (f) and (g) were added to the resulting mixture, followed by physical ripening for 40 minutes. To this were added (h) and, 2 minutes thereafter, (j) and (k) were added simultaneously over 30 minutes. The component (i) was added when 30% of (j) and (k) had been added. Thereafter, (l) and (m) were added simultaneously over 20 minutes. After 5 minutes of their addition, the temperature was lowered to 40° C. and desalting was repeated three times. To the resulting mixture were added (n) and then $H_2O$ to adjust the weight of the total mixture to 880 9. The contents of the final mixture were dispersed again by adjusting pH to 6.2. Thereafter, the temperature of the suspension was increased to 62° C. and optimal S+Au chemical sensitization was carried out using sodium thiosulfate, chloroauric acid and potassium thiocyanate.

Emulsion (B)

The procedure for the preparation of Emulsion (A) was repeated except that the KI content of (c) and (k) was adjusted to 6 mol % and that of (m) was adjusted to 4 mol %.

Emulsion (C)

The procedure for the preparation of Emulsion (A) was repeated except that the KI content of (c) and (k) was adjusted to 2 mol % and that of (m) was adjusted to 1 mol %. Thereafter, the thus prepared sample was mixed with 5% (as silver content) of a silver bromide fine grain emulsion (mean grain size, 0.05 μm) and 14.7 cc of a 1% KI solution, and the mixture was subjected to ripening at 62° C. for 60 minutes to form silver bromoiodide on the surface of the host grains.

Emulsion (D)

The procedure for the preparation of Emulsion (A) was repeated except that the KI content of (c) and (k) was adjusted to 4 mol % and that of (m) was adjusted to 1 mol %. Thereafter, the thus prepared sample was mixed with 3% (as silver content) of a silver bromide fine grain emulsion (mean grain size, 0.5 μm) and 14.7 cc of a 1% KI solution, and the mixture was subjected to ripening at 62° C. for 60 minutes to form silver bromoiodide on the surface of the host grains.

3. Preparation of Treating Solution and Pod

Since the treating solution is apt to be oxidized by the air, its preparation was carried out in a nitrogen atmosphere. After preparation in accordance with the formulation listed in Table 2, the resulting solution was packed in a plurality of breakable containers (pods) in an amount of 0.7 g per pod and used as a treating element.

TABLE 2

| | Treating Element | | | | |
|---|---|---|---|---|---|
| | 2A Comparison | 2B Comparison | 2C Invention | 2D Invention | 2E Invention |
| Titanium dioxide | 5 g | 5 g | 5 g | 5 g | 5 g |
| Potassium hydroxide | 280 g | 280 g | 280 g | 280 g | 280 g |
| Uracil | 90 g | 90 g | 90 g | 90 g | 90 g |
| Sodium thiosulfate | 1 g | 1 g | 1 g | 1 g | 1 g |
| Tetrahydropyrimidinethione | — | - 0.2 g | 0.2 g | 0.4 g | 0.2 g |
| 2,4-Dimercaptopyrimidine | 0.2 g | 0.2 g | 0.2 g | 0.2 g | 0.2 g |

TABLE 2-continued

| | Treating Element | | | | |
|---|---|---|---|---|---|
| | 2A Comparison | 2B Comparison | 2C Invention | 2D Invention | 2E Invention |
| Sodium 3-(5-mercaptotetrazolyl)-benzenesulfonate | 0.2 g | 0.2 g | 0.2 g | 0.2 g | 0.2 g |
| Potassium iodide | — | — | 0.4 g | 0.4 g | 0.3 g |
| Zinc nitrate ($9H_2O$) | 40 g | 40 g | 40 g | 40 g | 40 g |
| Triethanolamine | 6 g | 6 g | 6 g | 6 g | 6 g |
| Hydroxyethyl cellulose | 45 g | 45 g | 45 g | 45 g | 45 g |
| N,N-Bis(methoxyethyl)hydroxylamine (17% aqueous solution) | 220 g | 220 g | 220 g | 220 g | 220 g |
| 4-Methyl-4-hydroxymethyl-1-phenyl-3-pyrazolidinone | 2 g | 2 g | 2 g | 2 g | 2 g |
| Water | 1300 ml | 1300 ml | 1300 ml | 1300 ml | 1300 ml |

4. Spreading Treatment

Samples (001) to (014) were prepared by combining the thus obtained image-receiving element, each of light-sensitive elements (1A) to (1D) and each of treating elements 2A) to (2E). After treating each sample with continuous gradation exposure for 1/10 second and spreading the resulting sample at 25° C. with a liquid thickness of 35 μm, the image-receiving element was peeled off 15 or 30 seconds later and checked for its optical density to evaluate maximum density ($D_{max}$), sensitivity (S0.6) and color tone. The sensitivity (S0.6) was expressed as the relative logarithmic value of the inverse number of the exposure value at the density of $D_{min}+0.6$. Color tone was evaluated by visual observation. The results are shown in Table 3.

TABLE 3

| Sample*1 | Elements S.E.*2 | Elements T.E.*3 | $D_{max}$ 15 sec. | $D_{max}$ 30 sec. | S0.6 15 sec. | S0.6 30 sec. | Color tone |
|---|---|---|---|---|---|---|---|
| 001 (CE) | 1A | 2A | 1.52 | 1.85 | 2.05 | 1.90 | brown |
| 002 (CE) | 1B | 2A | 1.59 | 1.86 | 1.95 | 1.86 | light brown |
| 003 (CE) | 1A | 2B | 1.55 | 1.86 | 1.99 | 1.89 | pitch-black |
| 004 (CE) | 1B | 2B | 1.60 | 1.83 | 1.92 | 1.84 | pitch-black |
| 005 (CE) | 1A | 2C | 1.43 | 1.80 | 2.05 | 1.89 | blue black |
| 006 (CE) | 1B | 2C | 1.50 | 1.80 | 1.94 | 1.83 | blue purple |
| 007 (IE) | 1C | 2C | 1.78 | 1.80 | 1.97 | 1.95 | pitch-black |
| 008 (IE) | 1D | 2C | 1.76 | 1.80 | 1.98 | 1.96 | pitch-black |
| 009 (CE) | 1A | 2D | 1.37 | 1.78 | 2.05 | 1.91 | blue gray |
| 010 (CE) | 1B | 2D | 1.45 | 1.80 | 1.98 | 1.85 | blue black |
| 011 (IE) | 1C | 2D | 1.80 | 1.81 | 1.97 | 1.96 | pitch-black |
| 012 (IE) | 1D | 2D | 1.79 | 1.81 | 1.98 | 1.97 | pitch-black |
| 013 (IE) | 1C | 2D | 1.79 | 1.81 | 1.97 | 1.96 | pitch-black |
| 014 (IE) | 1D | 2D | 1.77 | 1.80 | 1.97 | 1.97 | pitch-black |

Notes:
*1CE and IE indicate comparative example and inventive example, respectively.
*2Light-sensitive element
*3Treating element As is evident from the results shown in Table 3, transfer images formed on samples (007), (008) and (011) to (014) in which the light-sensitive element and the treating element of the present invention were used in combination showed excellent photographic characteristics with high sensitivity and rapid image completion, in comparison with comparative samples (001) to (006), (009) and (010). In addition, all of the transfer images of the present invention showed excellent pitch-black color tones, while some transfer images of the comparative samples showed poor color tones depending on the combinations.

Thus, it is apparent that there has been provided, in accordance with the present invention, a process for forming images by a silver salt diffusion transfer process. According to the present invention, a film unit with rapid image completion and high sensitivity can be obtained, as well as a process for forming pitch-black images without requiring on image stabilization treatment after peeling of the image-receiving element.

Although preferred embodiments of the invention have been described, many modifications and variations may be made thereto in the light of the above teachings. It is therefore to be understood that within the scope of the appended claims, the invention may be practiced otherwise than as specifically described.

What is claimed is:

1. A silver salt diffusion transfer image-forming process which comprises developing an imagewise exposed light-sensitive element comprising a light-sensitive silver halide emulsion layer using an alkaline treating element containing a silver halide solvent, thereby converting at least a portion of the unexposed silver halide in the emulsion layer into a transferable complex silver salt, and subsequently transferring at least a portion of the complex silver salt to an image-receiving element comprising an image-receiving layer containing silver precipitation nuclei, wherein the light-sensitive silver halide emulsion layer comprises silver bromoiodide or silver bromoiodochloride having a silver iodide content of 0.5 to 3.5 mol %, wherein silver bromoiodide having a silver iodide content of 1 to 5 mol % is formed on the surface of the silver halide grains in an amount of from 3 to 10% on a silver basis after completion of chemical sensitization, and wherein the alkaline treating element comprises a water-soluble iodide in an amount of from 0.3 to 3.0 mM/l and tetrahydrophyrimidinethione in an amount of from 0.3 to 3.0 mM/l.

2. A silver salt diffusion transfer image-forming film unit comprising a light-sensitive element having a light-sensitive silver halide emulsion layer, an alkaline treating element, and an image-receiving element, wherein the light-sensitive silver halide emulsion layer contains a light-sensitive silver halide emulsion which comprises silver bromoiodide or silver bromoiodochloride having a silver iodide content of 0.5 to 3.5 mol %, wherein silver bromoiodide having a silver iodide content of 1 to 5 mol % is formed on the surface of the silver halide grains in an amount of from 3 to 10% on a silver basis after completion of chemical sensitization, and wherein the alkaline treating element comprises a water-soluble iodide in an amount of from 0.3 to 3.0 mM/l and tetrahydropyrimidinethione in an amount of from 0.3 to 3.0 mM/l.

* * * * *